United States Patent [19]

Sawyer

[11] Patent Number: 4,993,751

[45] Date of Patent: Feb. 19, 1991

[54] RECORD BOOK

[76] Inventor: Bruce A. Sawyer, 7100 Foothill Ranch Rd., Santa Rosa, Calif. 95404

[21] Appl. No.: 423,952

[22] Filed: Oct. 18, 1989

[51] Int. Cl.[5] ..... B41L 1/20

[52] U.S. Cl. ..... 282/8 R; 282/9 R; 282/23 A

[58] Field of Search ..... 282/8 R, 9 R, DIG. 2, 282/11.5 R, 23 A, 1 R, 2, 22 R; 281/29

[56] References Cited

U.S. PATENT DOCUMENTS

| | | | |
|---|---|---|---|
| 2,510,263 | 6/1950 | Stein | 282/DIG. 2 |
| 4,029,341 | 6/1977 | Neill et al. | 282/22 R |
| 4,789,187 | 12/1988 | Corlew et al. | 282/9 R |
| 4,793,758 | 12/1988 | Hanson et al. | 281/29 |
| 4,798,401 | 1/1989 | Greig | 282/22 R |

*Primary Examiner*—Paul A. Bell

*Attorney, Agent, or Firm*—Larry D. Johnson

[57] ABSTRACT

A record book provides a notebook wherein at least some of the pages permit affixation of a previously completed document into the book. The document is attached to the record book by a peel-off covered (lined) adhesive strip or other attachment mechanism. The invention also includes an imaging structure for providing a carbon or carbonless copy of the user's endorsement impression on the adhesive page. A valid record would thus show identical endorsement traces on the original affixed document and the adhesive page permanently bound into the record book.

10 Claims, 2 Drawing Sheets

RECORD BOOK

BACKGROUND OF THE INVENTION

1. Field of the Invention

This invention relates generally to books and notebooks, and more specifically to an improved tamper-resistant book suitable for record keeping.

2. Description of the Prior Art

Work books and laboratory notebooks are commonly used in research and development work, corporate engineering departments, and the like, to keep a record of the work in progress of each engineer or technician. After the proper signing, dating, and witnessing of these notebooks, they can serve as a legal (evidentiary) record to prove the date of conception of inventions and/or improvements, and can be used to support potentially valuable patent rights. However, many engineers and inventors have some aversion to using such traditional notebooks because the books often serve only as a collection of notes for ill-conceived ideas, most of which ideas are quickly deemed unusable and therefore discarded. Instead, these engineers prefer to work their ideas out on sheets of paper, or on microcomputers or computer workstations, and after the ideas have been developed to an appropriate degree, the information is then transcribed into a traditional notebook and properly witnessed. This process, however, is frequently neglected because of the additional steps involved.

SUMMARY OF THE INVENTION

The record book of this invention is an improvement to a legal bound type of notebook, wherein at least some of the pages provide a means for affixing a previously completed document, drawing, computer printout, etc., into the book. The document or drawing of interest would be attached to the record book by a peel-off covered (lined) adhesive strip or other attachment mechanism that is part of at least some of the pages of the book, with those pages bound or stitched into the backing of the book in the same manner as the other pages.

The adhesive used on these adhesive-backed pages could provide very strong holding power so that tampering with the interface (as with document removal and replacement) would be obvious. It is desirable, however, to additionally enable a positive indication of an alteration of a previous endorsement, as where a previously-affixed document has been removed from the record book and replaced with a fraudulent substitute document. Accordingly, this invention includes an imaging means for providing a carbon or carbonless copy of the user's and/or witnesses endorsement impression placed on the adhesive page. A valid record would show identical endorsement traces on the original affixed document and the adhesive page permanently bound into the record book.

The adhesive-backed pages would preferably be more narrow than the other pages in the record book, and extend only one or two inches from the spine of the book, and thus would not waste the full size page space allotted to the other pages. The number and disposition of such paste-in stubs are arbitrary, and would be determined by marketing data and experience. For example, there might prove to be a need for a book that is made up exclusively of these paste-in stubs for use with computer print-outs. A more typical book might have from 25%-40% of these paste-in stubs distributed more or less uniformly throughout the book, e.g., one every three or four pages.

Another arrangement which could be easily implemented would be for a "signature" or set of these stubs to be stitched into the book at the front or back of the book (the front would be preferable because it would allow for the buildup of inserted documents). Another arrangement would provide a number of smaller signatures of the paste-in stubs alternating with signatures of regular pages. For example, a typical signature is made by folding a large sheet four times to make sixteen pages. Four such signatures would provide a book with sixty-four regular pages. A more narrow sheet of adhesive-backed paper could be folded three times to provide eight pages of stubs. Four of these "stub" signatures could be alternated between the "regular" signatures to provide thirty-two stubs for a book with a total of ninety-six pages. For higher volume, production strips of the adhesive material could be fed into the web machine before the large sheet is folded to make the signatures. After folding, the stubs would be interspersed throughout the book every two, three or four pages depending on the number of strips.

BRIEF DESCRIPTION OF THE DRAWINGS

The endorsement imaging attributes of this invention can be accomplished in several ways. First, the structure can be designed to yield an endorsement image that is or is not viewable without removal of the affixed original document. Next, the image or endorsement record that is formed may be normal or reverse (mirror-image). Finally, the imaging structure can be integral (not requiring a separate, complementary member to accomplish the image) or non-integral. These three variables yield the following eight permutations, three of which have been specifically illustrated.

1. viewable, normal image, integral;
2. viewable, normal image, non-integral;
3. viewable, reverse image, integral;

(FIG. 3)

4. viewable, reverse image, non-integral;

(FIG. 1)

5. non-viewable, normal image, integral;
6. non-viewable, normal image, non-integral;
7. non-viewable, reverse image, integral; and
8. non-viewable, reverse image, non-integral.

Figure 1:
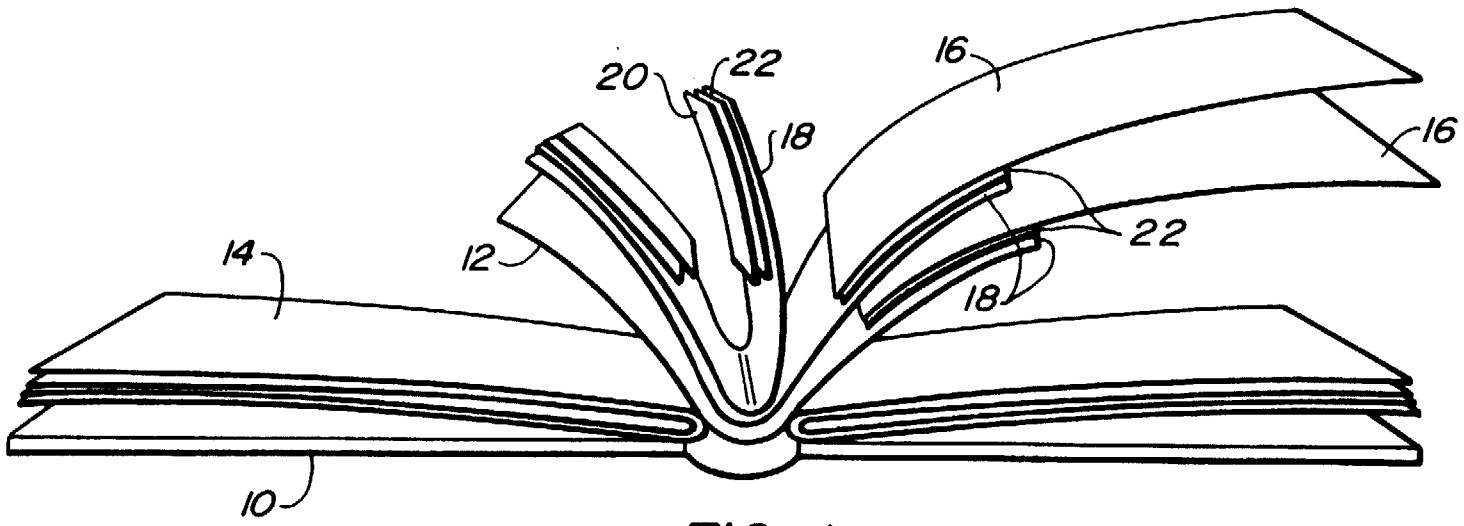
Figure 2:
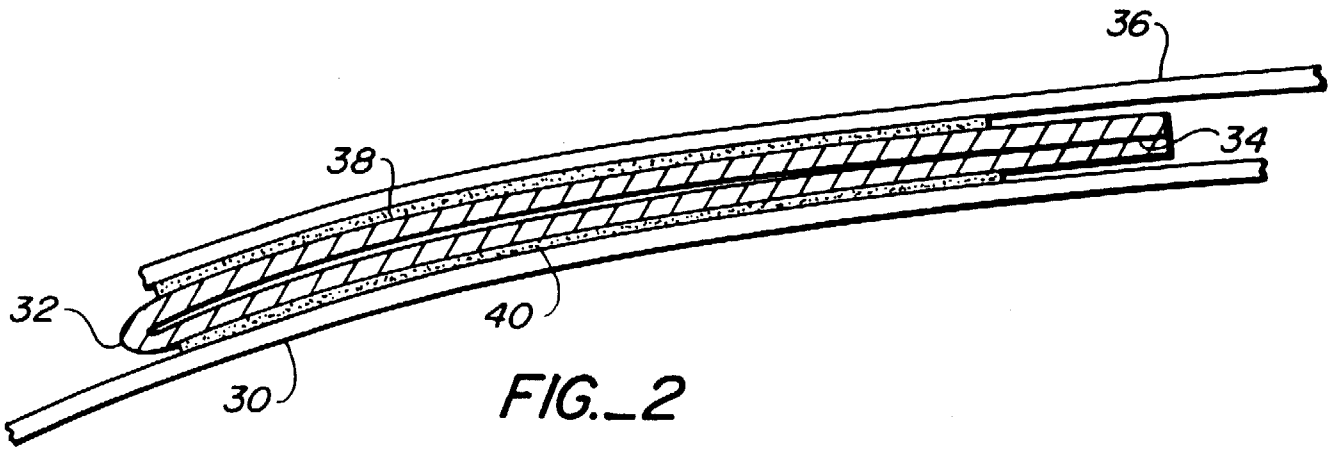
(FIG. 2)
Figure 3:
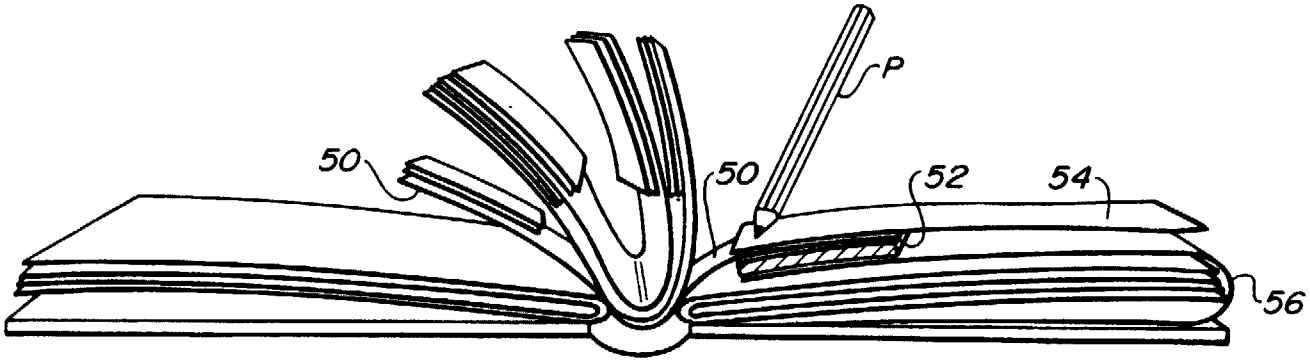
Figure 4:
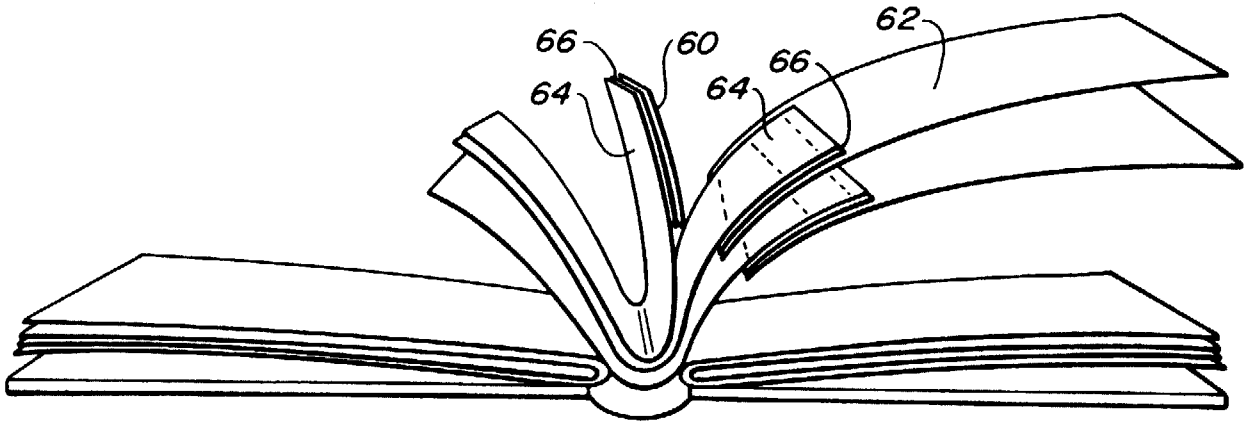

FIG. 1 is a top perspective view of a record book of this invention, illustrating a signature portion of paste-in pages (stubs) interposed between signature portions of regular pages in a bound book, and further illustrating a pair of original documents as affixed to a corresponding pair of non-viewable, normal image, integral embodiment paste-in stubs;

FIG. 2 is a partially cutaway top view of a page from a record book of this invention, illustrating an original document as affixed to a viewable, normal image, integral embodiment paste-in stub;

FIG. 3 is a top perspective view of a record book of this invention, illustrating an original document as affixed to a viewable, reverse image, non-integral embodiment paste-in stub with complementary backing; and FIG. 4 is a top perspective view of a record book of this invention illustrating an alternate version of the structure depicted in the embodiment of FIG. 1, in which the endorsement is made on the paste-in stub, and a copy made on the original document.

DETAILED DESCRIPTION OF A PREFERRED EMBODIMENT

FIG. 1 is a top perspective view of a record book 10 of this invention, illustrating a signature portion of paste-in record page portions or stubs 12 interposed between signature portions of regular pages 14, and further illustrating a pair of original documents 16 as affixed to a corresponding pair of non-viewable, normal image, integral embodiment paste-in stubs 18. This is arguably the simplest embodiment of the invention, in which a liner 20 is peeled off of stub 18 to expose an adhesive 22, which incorporates microencapsulated dye substance (or other pressure-activated imaging process material) into its adhesive matrix. Thus, when original document 16 is affixed and the user endorses the document over the stub, the microspheres rupture and leave a normal copy of the endorsement on the front of the stub. In this arrangement, the thickness of the stub itself provides an adequate backing to prevent ghost images on subsequent stubs, obviating the need for a separate, non-integral backing.

However, since in this embodiment the endorsement copy is retained on the front of the stub 18 and beneath the affixed document 16, it is not visible for comparison with the original endorsement until the affixed document is itself physically removed. Accordingly, this embodiment may only be suitable in certain applications, as with an in-court examination and comparison of the endorsements.

FIG. 2 is a partially cutaway top view of a page from a record book of this invention, illustrating an original document as affixed to a viewable, normal image, integral embodiment paste-in stub 30. The structure of this embodiment is similar to that depicted in the embodiment of FIG. 1, but with the inclusion of a strip 32 of clear plastic or other transparent material folded over and relasably secured upon itself by a tacky adhesive 34. The strip 32 is positioned between the affixed original document 36 and the stub 30, so that a normal adhesive 38 secures the document to the outer half of the plastic strip, and an adhesive/dye mixture 40 (as in the embodiment of FIG. 1) secures the inner half of the plastic strip to the stub 30. Temporary release of the edge of the folded plastic at adhesive 34 enables the document to be lifted away from (but still be attached to) the stub, and the copy of any endorsement made onto the stub can be viewed through the inner half of the clear plastic. As with the embodiment illustrated in FIG. 1, this endorsement is normal (not reversed), but unlike the embodiment illustrated in FIG. 1, it can be easily viewed at any time without removal of the affixed document from the book. Furthermore, the stub itself again provides adequate backing to prevent ghost images on subsequent stubs.

FIG. 3 is a top perspective view of a record book of this invention, illustrating an original document as affixed to a viewable, reverse image, non-integral embodiment paste-in stub 50 and complementary backing 52. A pencil P is shown inscribing an endorsement (impression) on the original document affixed to the stub.

In this embodiment, a separate backing member 52 bearing microencapsulated dye substance ink, carbon paper, or other pressure-activated imaging process material is manually placed behind stub 50 so that endorsement of original document 54 causes a reversed (mirror-image) copy of that endorsement to be imprinted on the back of the stub. The backing member 52 also acts as a backup to prevent ghost images on (the backs of) subsequent stubs. In an alternate version, the backing member merely isolates the lower special pages (stubs) from the pressure of signing, and the bottoms of the special pages (stubs) incorporate self-contained no-carbon-required material so that a reverse viewable image is created.

In an alternate version of this embodiment, the stub 50 itself is made of or coated with one part of a no-carbon-required paper material, while the backing member includes the complementary part of the no-carbon-required paper material, so that the endorsement image is created only upon juxtaposition of the two materials. This arrangement, at the very least, may reduce the messiness associated with carbon paper and related materials.

As a further alternate version of this embodiment, backing member 52 may be permanently secured to the record book by carrier 56, so that the backing member is always accessible, and yet easily folded out of the way when not in use.

FIG. 4 is a top perspective view of a record book of this invention illustrating an alternate version of the structure depicted in the embodiment of FIG. 1, in which the endorsement is made on the paste-in stub, and a copy made on the original document. Here, liner 60 is removed and original document 62 is affixed to the bottom of stub 64 by adhesive/dye matrix 66, so that the user endorses the stub (instead of the original document), which creates a normal copy of that endorsement on the document Of course, this stub-endorsement version could be modified by the inclusion of a strip of transparent material as in the embodiment of FIG. 2, to yield a viewable copy of the endorsement on the original document While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A record book comprising:

a book member including at least one record page portion;

said record page portion bearing adhesive means for attachment of an original document, said adhesive means comprising an adhesive strip covered with a removable liner; and said record page portion further including imaging means for producing a visible copy of an impression placed on said original document.

2. The record book of claim 1 wherein said book includes a plurality of record page portions interposed between regular pages.

3. The record book of claim 1 wherein said record page portion imaging means includes a separate backing member bearing pressure-activated imaging process material, said backing member conditioned for manual juxtaposition with said record page portion.

4. The record book of claim 1 wherein said record page portion imaging means comprises said record page portion bearing one part of a no-carbon-required paper material, and a separate backing member bearing a complementary part of a no-carbon-required paper material.

5. The record book of claim 4 wherein said backing member is permanently secured to said record book by a carrier member.

6. The record book of claim 1 wherein said imaging means comprises a pressure-activated imaging process material.

7. The record book of claim 6 wherein said pressure-activated imaging process material is incorporated into said adhesive means.

8. The record book of claim 6 wherein said pressure-activated imaging process material comprises a micro-encapsulated dye substance.

9. The record book of claim 1 wherein said adhesive means includes a folded transparent strip enabling unfolding of said strip and viewing of said record page portion.

10. The record book of claim 1 wherein said record page portion comprises a stub portion.

* * * * *